US008087826B1

(12) United States Patent
Blythe et al.

(10) Patent No.: US 8,087,826 B1
(45) Date of Patent: Jan. 3, 2012

(54) SLIDER TRACK WITH IMPROVED SEAL STRENGTH

(75) Inventors: James S. Blythe, Libertyville, IL (US); Steven P. Long, Chatham, IL (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 13/165,514

(22) Filed: Jun. 21, 2011

Related U.S. Application Data

(63) Continuation of application No. 13/102,637, filed on May 6, 2011, now abandoned.

(51) Int. Cl.
*B65D 33/16* (2006.01)
*A44B 1/04* (2006.01)
*A44B 19/00* (2006.01)

(52) U.S. Cl. ..... 383/64; 24/400; 24/585.12

(58) Field of Classification Search ..... 383/64, 383/63, 59; 24/400, 585.12, 399
See application file for complete search history.

(56) References Cited

U.S. PATENT DOCUMENTS 2,581,604 A * 1/1952 Roehri ..... 24/400
2,994,469 A 8/1961 Troup
3,122,807 A 3/1964 Ausnit
3,173,184 A 3/1965 Ausnit
3,713,923 A 1/1973 Laguerre
4,212,337 A 7/1980 Kamp
4,907,321 A 3/1990 Williams
5,007,142 A 4/1991 Herrington
5,007,143 A 4/1991 Herrington
5,010,627 A 4/1991 Herrington et al.
5,020,194 A 6/1991 Herrington et al.
5,063,644 A 11/1991 Herrington et al.
5,067,208 A 11/1991 Herrington et al.
5,131,121 A 7/1992 Herrington et al.
5,192,135 A 3/1993 Woods et al.
5,211,482 A 5/1993 Tilman
5,283,932 A 2/1994 Richardson et al.
5,293,671 A 3/1994 Oda
5,293,672 A 3/1994 Tominaga et al.
5,301,394 A 4/1994 Richardson et al.

(Continued)

FOREIGN PATENT DOCUMENTS

FR 1564039 4/1969

(Continued)

*Primary Examiner* — Jes F Pascua
(74) *Attorney, Agent, or Firm* — Baker Botts LLP

(57) ABSTRACT

Rolling action reclosable fastener comprises a male track including a male profile, a female track including a female profile, and a slider disposed on the male and female tracks to matingly engage the male profile and the female profile. The slider includes a back and a pair of sidewall depending therefrom. The slider also includes a separator finger depending from the back between the pair of sidewalls and shaped along its length to first press together a bottom of the male and female profiles and then roll the profiles closed toward a top thereof as the slider moves toward the closed condition. The male profile comprises a base and a rib with a hook portion having an inwardly-directed surface including a projection defining an engagement surface. The female profile comprises a base and a first flange having an inwardly-directed surface including a projection defining an engaging surface. The engaging surface of the female track engages the engagement surface of the male track when in a closed condition with at least a portion of the male profile received by at least a portion of the female profile. A reclosable plastic bag with a rolling action reclosable fastener is also provided.

20 Claims, 17 Drawing Sheets

U.S. PATENT DOCUMENTS 5,403,094 A 4/1995 Tomic
5,482,375 A 1/1996 Richardson et al.
5,542,766 A 8/1996 Cadwallader
5,542,837 A 8/1996 Johnston
5,542,838 A 8/1996 Wilhelm et al.
5,566,429 A 10/1996 Martinez et al.
5,577,305 A * 11/1996 Johnson ..... 24/585.12
5,638,587 A 6/1997 Martinez et al.
5,664,299 A 9/1997 Porchia et al.
5,774,955 A 7/1998 Borchardt et al.
5,794,315 A 8/1998 Crabtree et al.
5,836,056 A 11/1998 Porchia et al.
5,851,070 A 12/1998 Dobreski et al.
5,871,281 A 2/1999 Stolmeier et al.
5,919,535 A 7/1999 Dobreski et al.
5,947,603 A 9/1999 Tilman
5,953,796 A 9/1999 McMahon et al.
5,956,815 A 9/1999 O'Connor et al.
5,956,924 A 9/1999 Thieman
5,964,532 A 10/1999 St. Phillips et al.
6,009,603 A 1/2000 Gallagher
6,014,795 A 1/2000 McMahon et al.
6,047,450 A 4/2000 Machacek et al.
6,059,456 A 5/2000 May
6,112,374 A 9/2000 Van Erden
6,178,602 B1 1/2001 Burke et al.
6,182,337 B1 2/2001 Machacek et al.
6,209,287 B1 4/2001 Thieman
6,216,423 B1 4/2001 Thieman
6,217,215 B1 * 4/2001 Tomic ..... 383/63
6,220,754 B1 4/2001 Stiglic et al.
6,247,844 B1 6/2001 Tomic et al.
6,257,763 B1 7/2001 Stolmeier et al.
6,286,189 B1 9/2001 Provan et al.
6,306,071 B1 10/2001 Tomic
6,327,754 B1 12/2001 Belmont et al.
6,360,513 B1 3/2002 Strand et al.
6,363,692 B2 4/2002 Thieman
6,376,035 B1 4/2002 Dobreski et al.
6,402,375 B1 6/2002 Schreiter et al.
6,438,926 B1 8/2002 Thieman
6,439,771 B1 8/2002 Herrington
6,442,804 B2 9/2002 Turvey et al.
6,461,042 B1 10/2002 Tomic et al.
6,491,432 B2 * 12/2002 May ..... 383/64
6,499,272 B2 12/2002 Thieman
6,524,002 B2 2/2003 Tomic
6,568,046 B1 5/2003 Savicki et al.
6,571,430 B1 6/2003 Savicki et al.
6,575,628 B1 6/2003 Borchardt et al.
6,581,249 B1 6/2003 Savicki et al.
6,581,253 B2 6/2003 ErkenBrack
6,582,122 B2 6/2003 Shimizu
6,594,868 B1 7/2003 Savicki
6,595,689 B1 7/2003 Borchardt et al.
6,611,997 B1 9/2003 Savicki
6,612,002 B1 9/2003 Savicki
6,679,027 B2 1/2004 Schreiter
6,691,375 B1 2/2004 Savicki
6,728,997 B1 5/2004 Savicki et al.
6,733,622 B2 5/2004 McMahon et al.
6,739,755 B2 5/2004 Schreiter
6,817,763 B2 11/2004 Tomic
6,846,107 B2 1/2005 Sweeney et al.
6,854,887 B2 2/2005 Anderson
6,874,205 B1 4/2005 Savicki
6,874,937 B2 * 4/2005 Ausnit ..... 383/64
6,883,210 B1 4/2005 Savicki
6,895,641 B1 5/2005 Savicki
6,907,713 B2 6/2005 Thieman
6,910,806 B2 6/2005 Strand et al.
6,913,387 B2 7/2005 Strand et al.
6,918,230 B2 7/2005 Thieman
6,925,688 B1 8/2005 Savicki
6,925,779 B2 8/2005 Thieman
6,928,702 B1 8/2005 Savicki et al.
6,948,849 B2 9/2005 Schreiter
6,954,970 B2 10/2005 McMahon et al.
6,962,034 B2 11/2005 Thieman
6,962,440 B2 11/2005 Fenzl et al.
6,976,787 B2 12/2005 Plourde
6,979,289 B2 12/2005 McMahon et al.
6,981,299 B2 1/2006 Savicki
6,996,879 B1 2/2006 Savicki
7,017,240 B2 3/2006 Savicki
7,017,241 B2 * 3/2006 Bentsen ..... 24/400
7,033,451 B2 4/2006 McMahon et al.
7,052,181 B2 5/2006 Smith et al.
7,056,417 B2 6/2006 Haws et al.
7,080,429 B2 7/2006 Savicki
7,086,782 B2 8/2006 Strand et al.
D531,896 S 11/2006 Blythe
7,137,942 B2 11/2006 Savicki et al.
7,140,772 B2 11/2006 Bois
7,152,737 B2 12/2006 Chin
7,162,779 B2 1/2007 MacHacek
7,165,887 B2 1/2007 Strand et al.
7,182,514 B2 2/2007 Schreiter
7,213,303 B1 5/2007 Savicki
7,254,873 B2 8/2007 Stolmeier et al.
7,263,748 B2 9/2007 Blythe
7,305,742 B2 12/2007 Anderson
7,313,846 B2 1/2008 Stolmeier
7,320,545 B2 1/2008 Strand et al.
7,320,662 B2 1/2008 Thieman
7,322,747 B2 1/2008 Borchardt
7,377,015 B2 5/2008 Long et al.
7,383,675 B2 6/2008 Thieman
7,451,530 B2 11/2008 Meager
7,461,434 B2 12/2008 Ackerman
7,490,989 B2 2/2009 Kobetsky et al.
7,496,992 B2 3/2009 Ausnit
7,497,632 B2 3/2009 Kajino et al.
7,506,416 B2 3/2009 Hoffman et al.
7,536,758 B2 5/2009 Meager
7,540,662 B2 6/2009 Thieman
7,549,954 B2 6/2009 Blythe
7,552,573 B2 6/2009 Thieman
7,574,780 B2 8/2009 Meager
7,574,781 B2 8/2009 Ackerman et al.
7,574,782 B2 8/2009 Ackerman
7,611,283 B2 11/2009 Anderson
7,611,284 B2 11/2009 Borchardt et al.
7,614,500 B2 11/2009 Chin
2003/0223654 A1 * 12/2003 Gerrits ..... 383/63
2007/0116387 A1 5/2007 Hui et al.
2008/0110001 A1 5/2008 Ausnit

FOREIGN PATENT DOCUMENTS

GB 914203 12/1962
WO WO00/76338 12/2000
WO WO2006/030334 3/2006

* cited by examiner

SLIDER TRACK WITH IMPROVED SEAL STRENGTH

CROSS REFERENCE TO RELATED APPLICATIONS

This application is a continuation of U.S. patent application Ser. No. 13/102,637 filed May 6, 2011 now abandoned, which is incorporated by reference herein in its entirety for all purposes.

BACKGROUND OF THE INVENTION

1. Field of the Invention

The present application generally relates to reclosable fasteners with sliders particularly suited for thermoplastic bags and the like. Particularly, the present application relates to a rolling action fastener with increased seal strength.

2. Description of Related Art

A reclosable fastener for thermoplastic bags or the like include a pair of male and female tracks with interlocking rib and groove elements. Generally, two types of such reclosable fasteners exist—(i) push to close ("PTC") and (ii) zipper. The PTC fastener requires the application of an external force to open or close the engageable tracks, whereas the zipper fastener relies upon a slider for opening or closing the rib and groove elements. As such, the profile configuration of the reclosable track of a zipper fastener differs from that of a PTC fastener.

In the manufacture of thermoplastic film bags, a pair of these male and female fastener elements or tracks extend along the mouth of the bag and these male and female elements are adapted to be secured in any suitable manner to the flexible walls of the thermoplastic film bag. These elements may be integral marginal portions of such walls or the elements may be extruded separately and thereafter attached to the walls along the mouth of the bag. U.S. Pat. No. 5,007,143, which is incorporated by reference in its entirety, describes a zipper profile in which the cross-sectional shape of the zipper is such that the male and female elements can be engaged or closed by pressing the bottom together first, then rolling it closed toward the top. This configuration is referred to as a "rolling action" reclosable fastener.

However, there is a continued need to improve the seal strength of such conventional fasteners, yet still permitting the fasteners to be easily opened and closed.

SUMMARY OF THE INVENTION

The purpose and advantages of the present application will be set forth in and apparent from the description that follows, as well as will be learned by practice of the application. Additional advantages of the application will be realized and attained by the apparatus particularly pointed out in the written description and claims hereof, as well as from the appended drawings.

To achieve these and other advantages and in accordance with the purpose of the application, as embodied and broadly described, the application includes a reclosable fastener comprising a male track including a male profile, a female track including a female profile, and a slider disposed on the male and female tracks to matingly engage the male profile and the female profile when moved from an open condition toward a closed condition. The slider includes a back and a pair of sidewall depending therefrom. The slider also includes a separator finger depending from the back between the pair of sidewalls and shaped along its length to first press together a bottom of the male and female profiles and then roll the profiles closed toward a top thereof as the slider moves toward the closed condition. The male profile comprises a base and a rib with a hook portion having an inwardly-directed surface including a projection defining an engagement surface. The female profile comprises a base and a first flange having an inwardly-directed surface including a projection defining an engaging surface. The engaging surface of the female track engages the engagement surface of the male track when in the closed condition with at least a portion of the male profile received by at least a portion of the female profile.

As embodied herein, at least one of the male track and the female track can include a fin portion. For example, the female track can include a downwardly-depending fin portion defining a reference plane. The engaging surface and the engagement surface can engage each other at a location of contact when in the closed condition, the engaging surface having an angle of between about 30 degrees to about 80 degrees relative to the reference plane at the location of contact. Similarly the engagement surface can have an angle of between about 30 degrees to about 80 degrees relative to the reference plane at the location of contact. Preferably, the angle is about 45 degrees. Furthermore, the engaging surface and the engagement surface can each be angled at a location of contact generally perpendicular to a predetermined direction of pull. The engaging surface and the engagement surface form a mechanical interference when in the closed position, and the male and female profiles have complementary cross-sections. Additionally, the first flange embodied herein has an outwardly-directed surface at an angle of between about 10 degrees to about 30 degrees relative to the reference plane.

In accordance with another aspect, the inwardly-directed surface of the hook portion of the rib further can include a cam surface proximate the projection. The cam surface is configured to urge the engaging surface out of engagement with the engagement surface when the slider is moved toward the open condition. The rib can further include a second hook portion. The female profile can further include a second flange that can be arranged to deflect when the slider is moved from an open condition toward a closed condition. The second flange can maintain the male profile matingly engaged with the female profile when the slider is in the closed condition.

In accordance with another embodiment, the male profile further comprises an ear portion and the female profile further comprises an ear portion. The ear portion of the male profile can be in contact with the ear portion of the female profile when in the closed condition.

In accordance with another aspect, the slider disengages the male profile from the female profile when moved from the closed condition toward the open condition such that the slider first separates the top of the male and female profiles and then rolls the profiles open toward the bottom thereof as the slider moves toward the open condition.

The present application also provides a reclosable fastener comprising a male track including a male profile, a female track including a female profile, and a slider disposed on the male and female tracks to matingly engage the male profile and the female profile when moved from an open condition toward a closed condition. The slider is configured to first press together a bottom of the male and female profiles and then roll the profiles closed toward a top thereof as the slider moves toward the closed condition. The male profile comprises a base and a rib with a first hook portion and a second hook portion extending in opposite direction from the rib. The first hook portion has an inwardly-directed surface including a projection defining an engagement surface. The female profile comprises a base with a first flange and a second flange, the first flange having an inwardly-directed surface including a projection defining an engaging surface. The engaging surface of the female track engages the engagement surface of the male track when in the closed condition with at least a portion of the male profile received by at least a portion of the female profile. The fastener can have any of the additional features described above.

The present application also provides a reclosable plastic bag comprising first and second panels each having a top, a bottom, and first and second opposing sides and a reclosable fastener. The first and second panels are joined to each other along respective bottoms and first and second opposing sides. The reclosable fastener comprises a male track including a male profile, a female track including a female profile, and a slider disposed on the male and female tracks to matingly engage the male profile and the female profile when moved from an open condition toward a closed condition. The slider includes a back and a pair of sidewall depending therefrom. The slider also has a separator finger depending from the back between the pair of sidewalls and shaped along its length to first press together a bottom of the male and female profiles and then roll the profiles closed toward a top thereof as the slider moves toward the closed condition. The male profile comprises a base and a rib with a hook portion having an inwardly-directed surface including a projection defining an engagement surface. The female profile comprises a base and a first flange having an inwardly-directed surface including a projection defining an engaging surface. The engaging surface of the female track engages the engagement surface of the male track when in the closed condition with at least a portion of the male profile received by at least a portion of the female profile. Furthermore, the reclosable fastener can have any of the additional features described above.

It is to be understood that both the foregoing general description and the following detailed description are exemplary and are intended to provide further explanation of the application claimed.

The accompanying drawings, which are incorporated in and constitute part of this specification, are included to illustrate and provide a further understanding of the apparatus of the application. Together with the written description, the drawings serve to explain the principles of the application.

DETAILED DESCRIPTION OF THE PREFERRED EMBODIMENT

Figure 1:
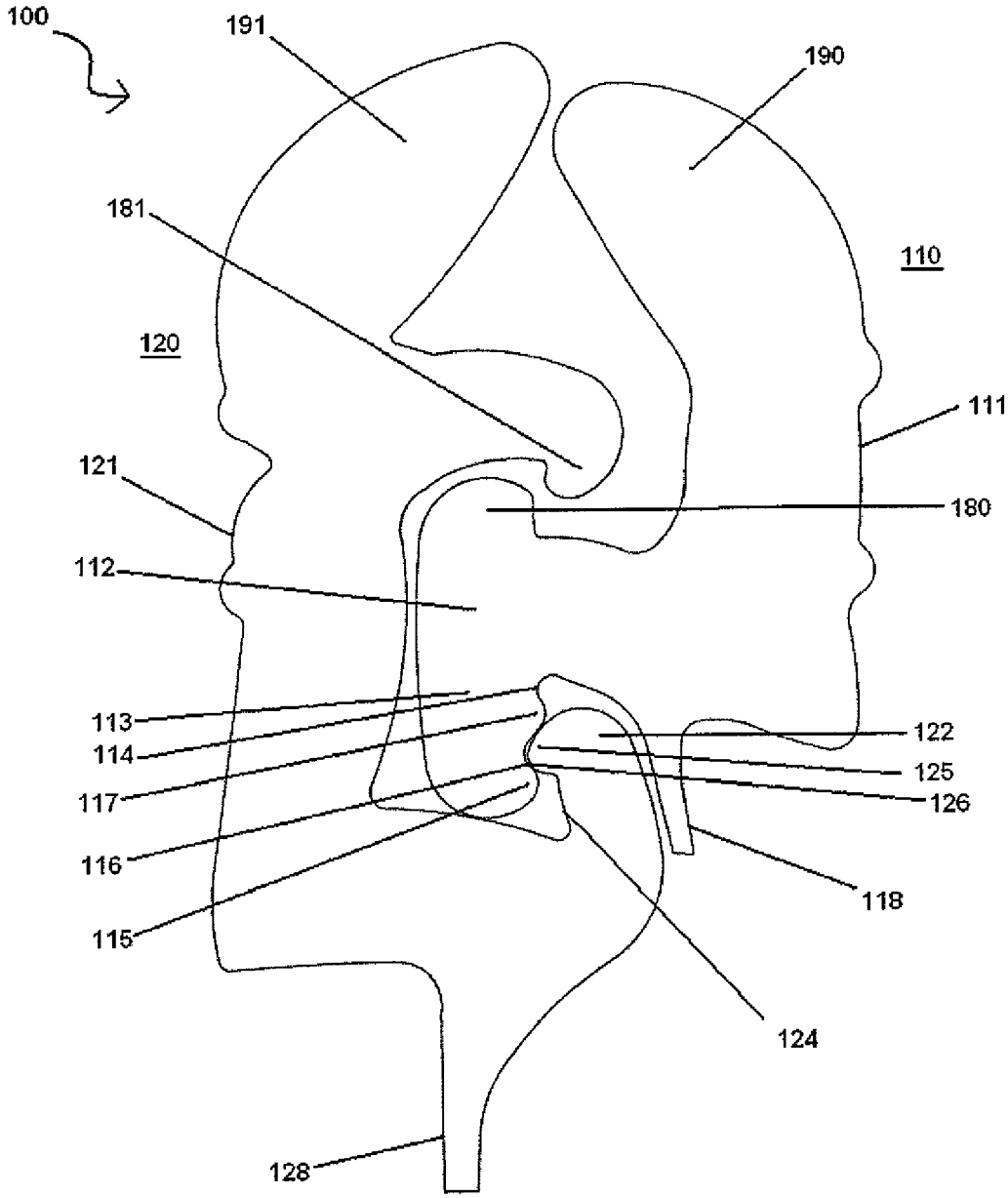
FIG. 1 is a cross-sectional side view of a fastener in a closed condition in accordance with the application.

Reference will now be made in detail to the present preferred embodiments of the application, examples of which are illustrated in the accompanying drawings. The fasteners presented herein generally are intended for thermoplastic bags, although other similar or suitable uses are contemplated. In accordance with the application, a reclosable fastener is provided. The reclosable fastener includes a male track including a male profile, a female track including a female profile, and a slider disposed on the male and female tracks to matingly engage the male profile and the female profile when moved from an open condition toward a closed condition. The slider includes a back and a pair of sidewall depending therefrom. The slider also includes a separator finger depending from the back between the pair of sidewalls and shaped along its length to first press together a bottom of the male and female profiles and then roll the profiles closed toward a top thereof as the slider moves toward the closed condition. The male profile comprises a base and a rib with a hook portion having an inwardly-directed surface including a projection defining an engagement surface. The female profile comprises a base and a first flange having an inwardly-directed surface including a projection defining an engaging surface. The engaging surface of the female track engages the engagement surface of the male track when in the closed condition with at least a portion of the male profile received by at least a portion of the female profile.

For purpose of explanation and illustration, and not limitation, an exemplary embodiment of the reclosable fastener in accordance with the application is shown in FIGS. 1 through 7 and is designated generally by reference character 100.

With reference to FIG. 1, the fastener 100 comprises a male track 110, a female track 120, and a slider 130 (shown in FIG. 13) disposed on the male and female tracks. The male track 110 includes a male profile comprising a base 111 and a rib 112 with a hook portion 113 having an inwardly-directed surface 114 including a projection 115 defining an engagement surface 116. The rib can include a second hook portion 180. As embodied herein, the male profile further includes an ear portion 190.

The female profile includes a female profile comprising a base 121 and a first flange 122 having an inwardly-directed surface 124. The inwardly-directed surface 124 includes a projection 125 that defines an engaging surface 126. The projection can be a curved surface or other suitable configuration to define an engaging surface in accordance with the features described herein. The female profile can include a second flange 181 and an ear portion 191. As can be seen in FIG. 1, the male and female profiles have complementary cross-sections.

Figure 3:
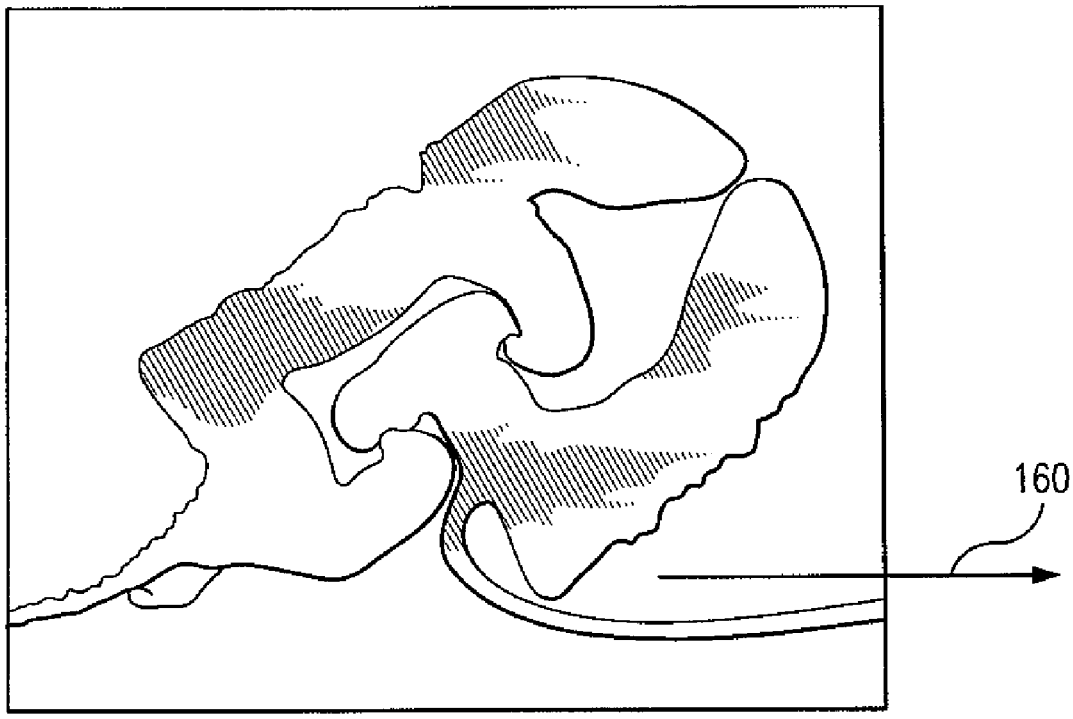
FIG. 3 is a sectional image of the fastener shown in FIG. 1 with a force applied in a predetermined direction of pull.
Figure 4:
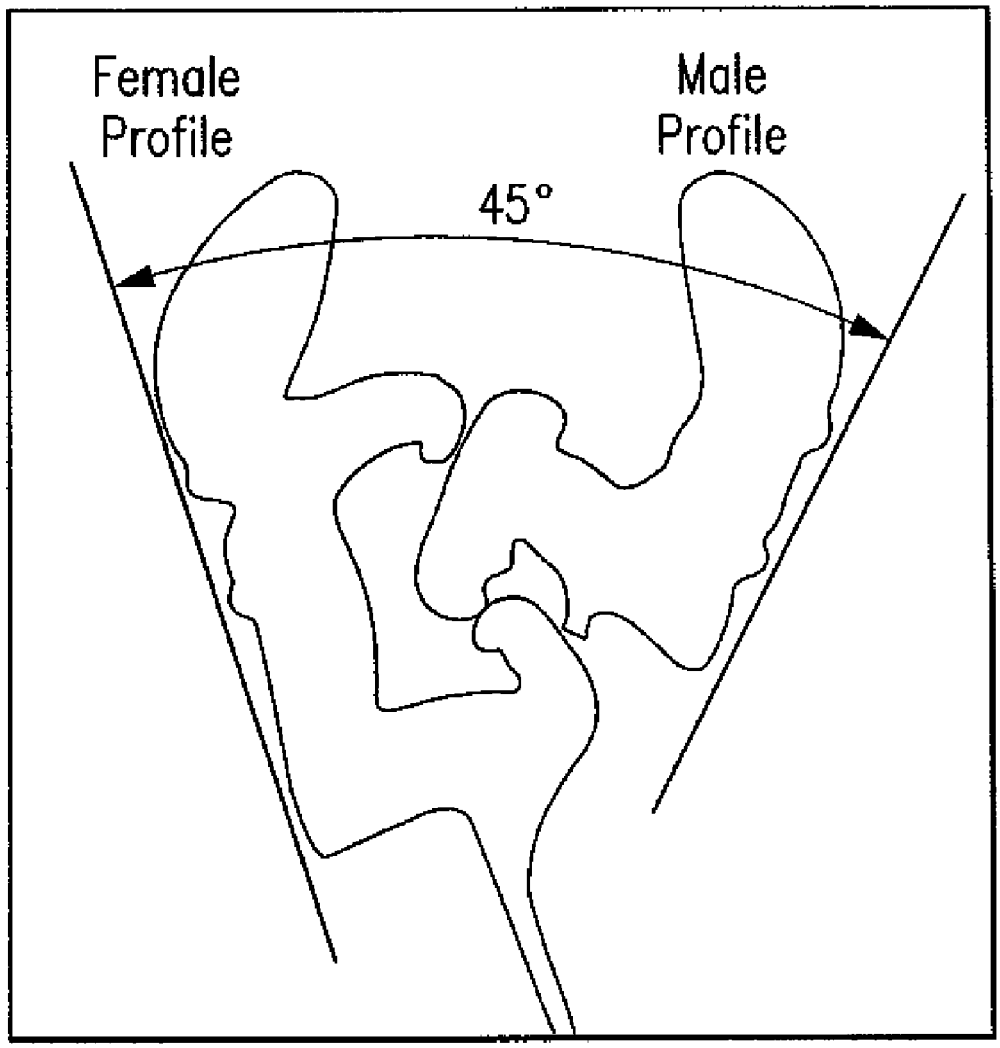
FIG. 4 is a cross-sectional side view of a fastener in a 45° open condition in accordance with the application.
Figure 5:
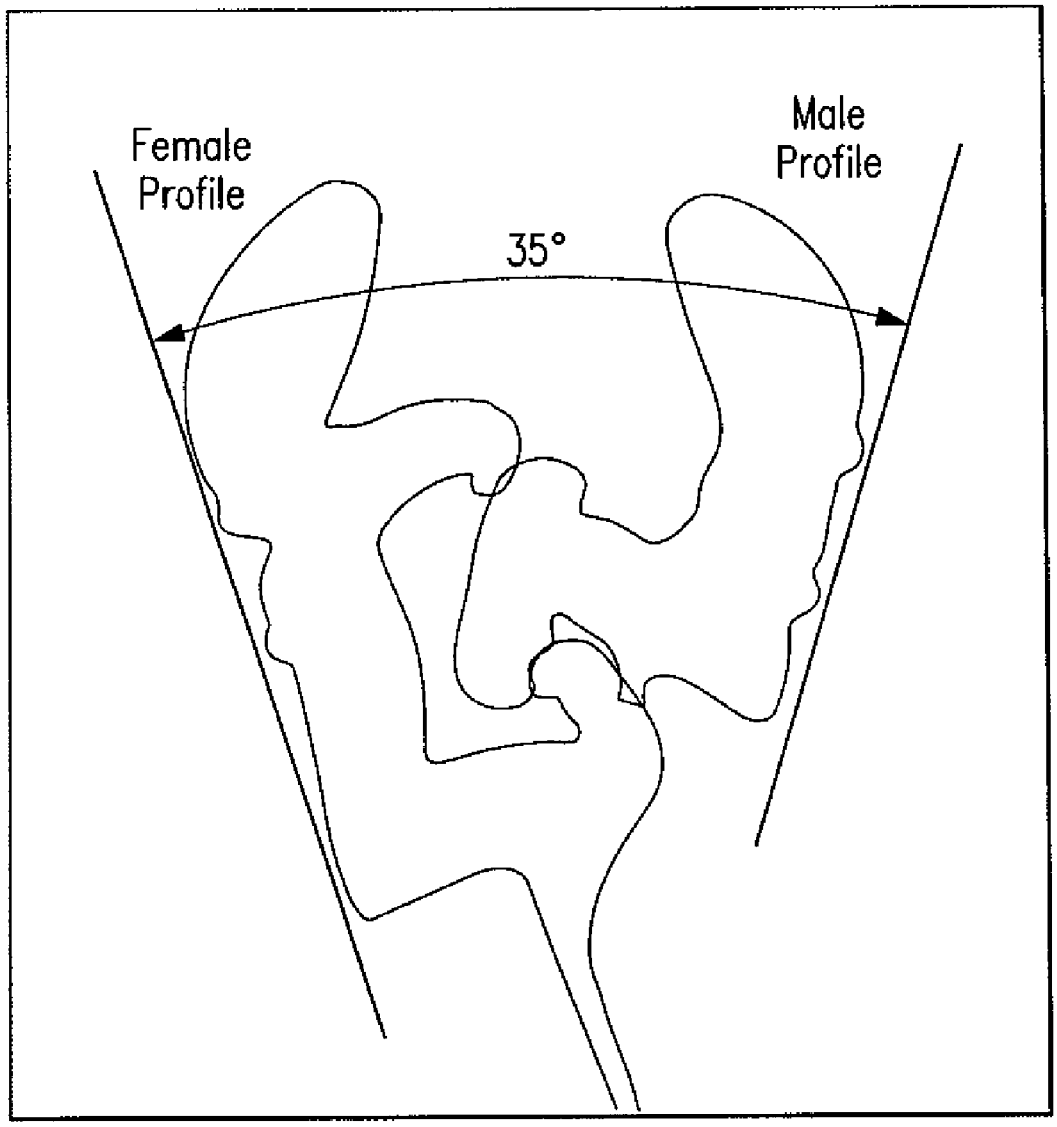
FIG. 5 is a cross-sectional side view of a fastener in a 35° open condition in accordance with the application.

The engaging surface of the female track 126 engages the engagement surface 116 defined by the projection of the male track when in the closed condition with at least a portion of the male profile received by at least a portion of the female profile, as shown in FIG. 1 for the purpose of illustration. The engaging surface and the engagement surface form a mechanical interference at a location of contact when in the closed position, which helps prevent the fastener from bursting open or otherwise compromising the seal formed by the track in the closed condition when a force is applied to the fastener in the direction of pull 160, as depicted in FIG. 3, thus increasing the seal strength of the fastener.

Figure 2:
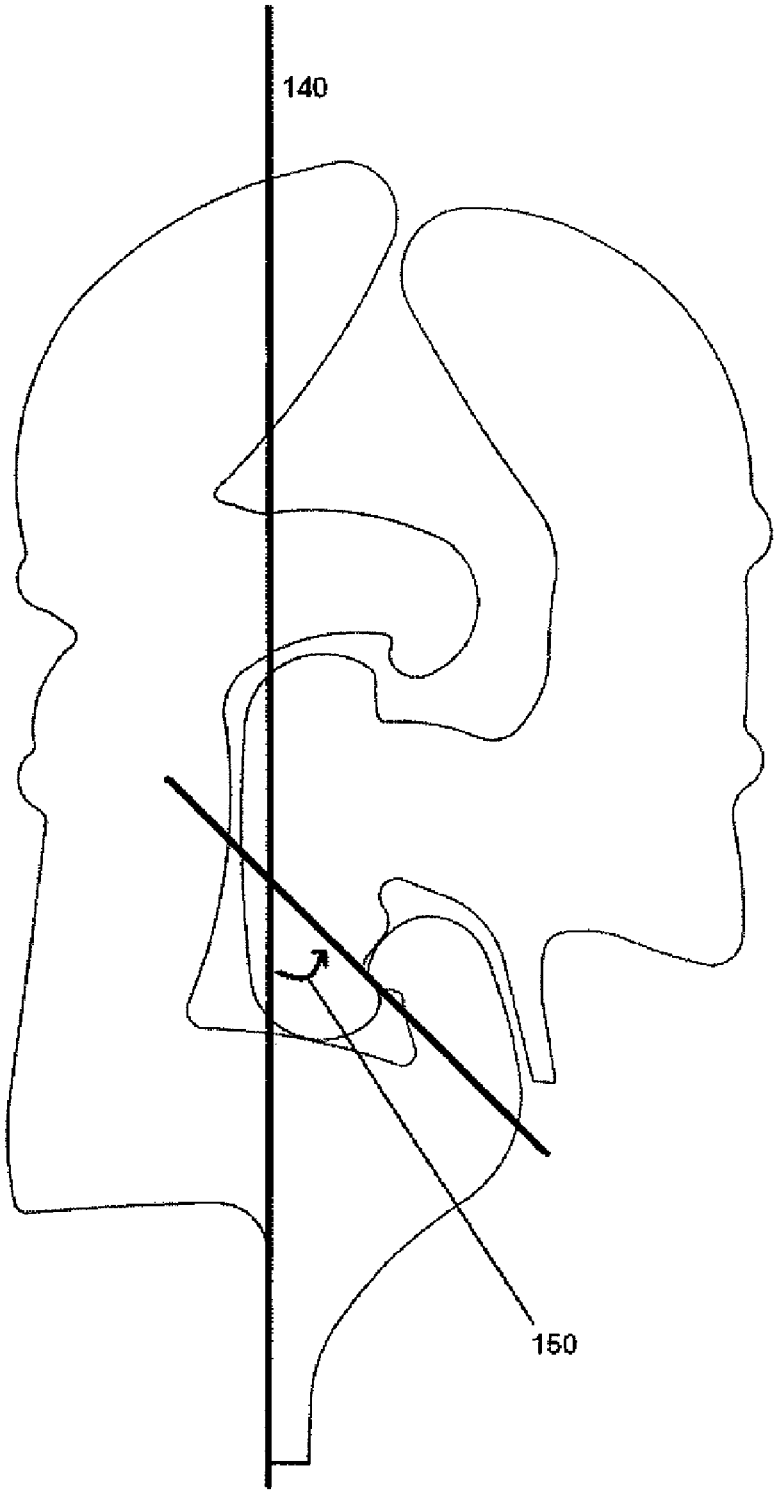
FIG. 2 is another cross-sectional side view of the fastener shown in FIG. 1 showing the angle of the engaging surface and the engagement surface at a location of contact relative to a reference plane.

As embodied herein, at least one of the male track and the female track can include a fin portion. For example, the female track can include a downwardly-depending fin portion 128 defining a reference plane 140, as shown in FIG. 2 for the purpose of explanation and illustration, and not limitation. The engaging surface and the engagement surface engage each other at a location of contact when in the closed condition. The engaging surface can have an angle 150 (shown in FIG. 2) of between about 30 degrees to about 80 degrees relative to the reference plane 140 at the location of contact. Similarly the engagement surface can have an angle 150 (shown in FIG. 2) of between about 30 degrees to about 80 degrees relative to the reference plane at the location of contact. Preferably, the angle is about 45 degrees. The angle of the engaging and engagement surfaces is selected to increase the seal strength yet still allow free rotation of the fastener to the open position so that it can be easily opened and closed using a slider. While possible, an angle greater than about 80 degrees will result in the male and female profiles locking together in the closed position causing difficulty for a consumer to easily open the fastener with the slider alone. While also possible, an angle less than about 30 degrees will not provide the desired seal strength. The predetermined direction of pull 160, as depicted in FIG. 3, relates to the angle the fastener profile naturally rotates as the bag film is pulled 180 degrees apart. The angle of the engaging surface and the engagement surface at a location of contact is optimized at an angle generally perpendicular to the predetermined direction of pull 160.

A straddling slider 130 is positioned on the male and female tracks to matingly engage the male profile and the female profile when moved along the fastener from an open condition toward a closed condition. As described in detail in U.S. Pat. No. 5,007,143, the contents of which are incorporated herein in its entirety, the slider first presses together a bottom of the male and female profiles and then rolls the profiles closed toward a top thereof as the slider moves toward the closed condition. The slider is configured to operate in this fashion on the fastener, holding the top open while it presses the bottom together, then pressing the top together while the slider passes by. Likewise, the slider can disengage the male profile from the female profile when moved from the closed condition toward the open condition such that the slider first separates the top of the male and female profiles and then rolls the profiles open toward the bottom thereof as the slider moves toward the open condition.

For example, the slider can be an inverted U-shaped plastic member having a back for moving along the top edges of the male and female tracks with side walls depending therefrom for cooperating with the male and female tracks and extending from an opening end of the slider to a closing end. The side walls can have a greater spacing at the opening end than the closing end. A separator finger depends from the back between the side walls and is inserted between the male and female tracks. The separator finger is shaped throughout the length to first press together a bottom of the male and female profiles and then roll the profiles closed toward a top thereof as the slider moves toward the closed condition. The separator finger can be configured to first hold the top of the male and female elements open while the slider first presses the bottom of the elements together and then permit the slider to press the top of the elements together while the slider moves in a closing direction. The slider is provided with shoulders projecting inwardly from the depending side walls and shaped throughout the length thereof for cooperation with the depending separator finger in creating the rolling action in opening and closing the reclosable interlocking male and female profile elements. Alternative sliders known in the art, such as those described in U.S. Pat. No. 5,007,143 and U.S. Design Pat. No. D531,896, can alternatively be used.

Figure 8:
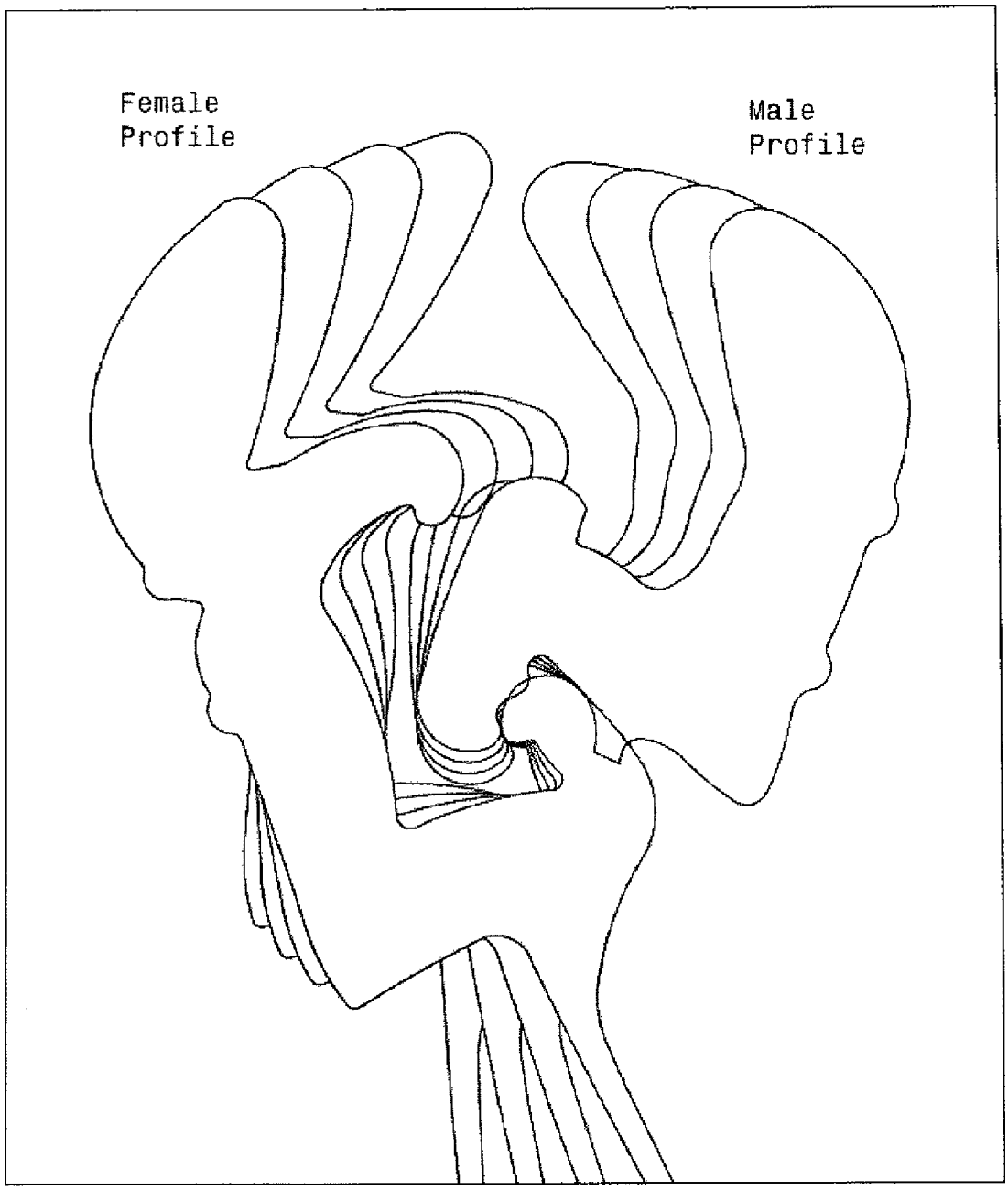
FIG. 8 is a cross-sectional side view of a fastener showing rolling action in accordance with the application.
Figure 9:
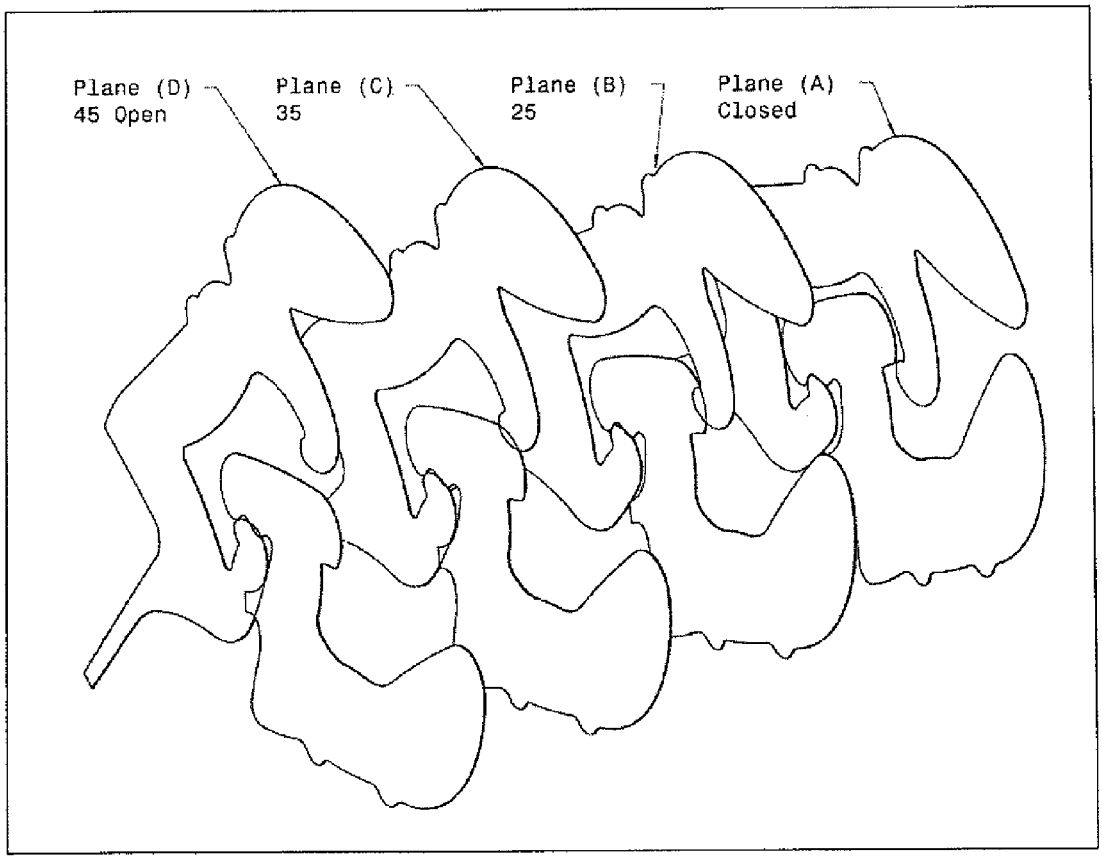
FIG. 9 is a cross-sectional side view of a fastener showing progressive planes along the length of the fastener in accordance with the application.

In operation, the male and female profiles twist relative to each other when the fastener is moved between the open and closed conditions, which provides the rolling action of the fastener. The rolling action can be any pivoting or twisting action including any incidental flexing or deflection that occurs at any point during the closing or opening process. For the purpose of illustration and not limitation, FIGS. 4 through 7 show progressive cross sections with a 45° (open) to 0° (closed) angle of twist. The progression of FIGS. 4 through 7 show the fastener rolling closed based upon the movement of the slider. Likewise, the fastener rolls open by reversing the direction and looking at the progression of FIGS. 7 to 4. Similarly, for the purpose of illustration and not limitation, FIGS. 8 and 9 show the planes of each cross section stacked progressively for the fastener moving from an open condition to a closed condition. The male and female tracks twist relatively easily along the length, but are quite rigid in the cross sectional planes shown. Accordingly, the tracks may be opened and closed easily without distorting the cross sectional shape of the profiles. Therefore, stiffer plastics, such as high density polyethylene and other suitable plastics, may be used because the cross sectional shape does not need to be distorted. This is advantageous because the use of stiffer plastics increases the fastener's burst strength.

Figure 6:
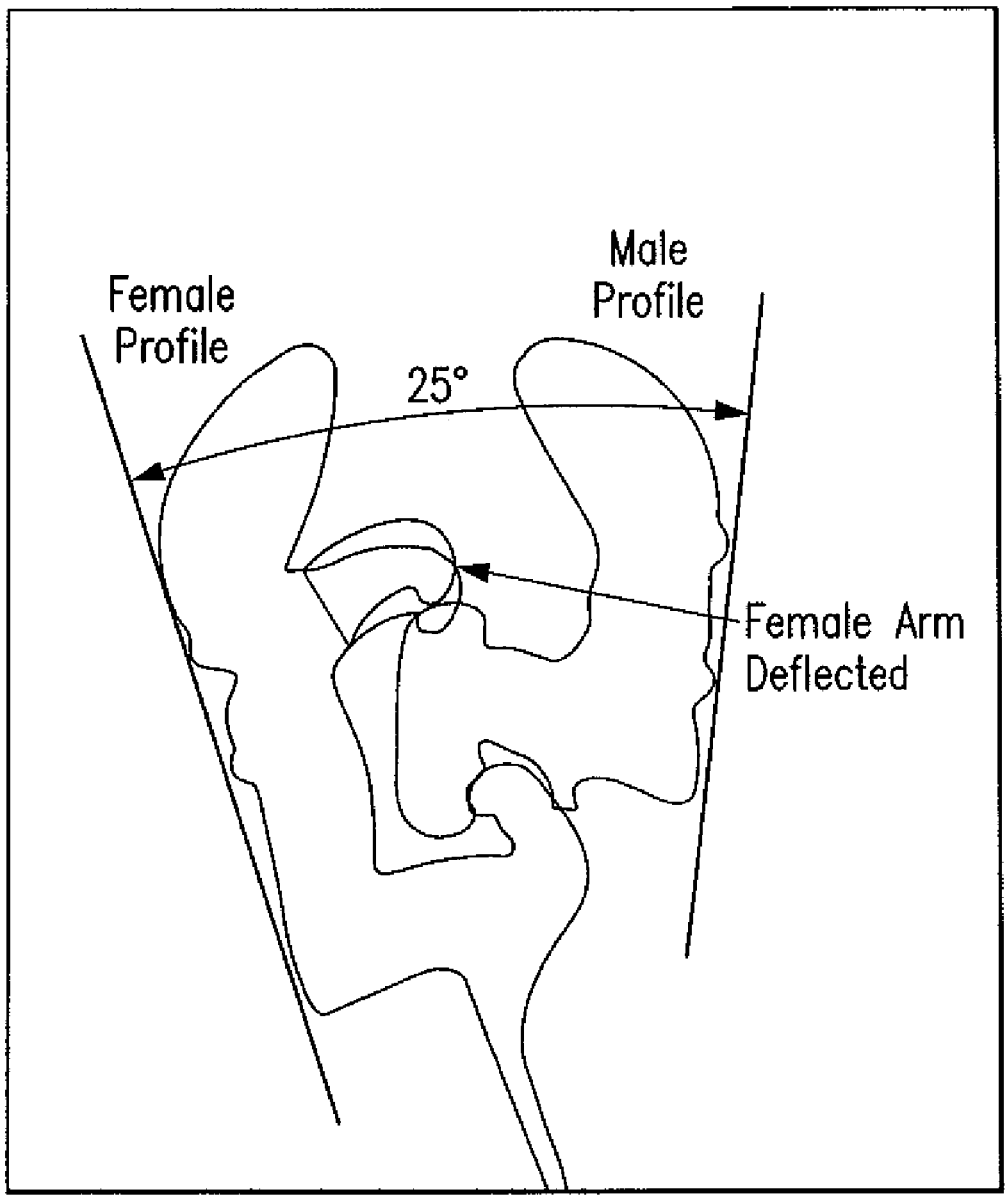
FIG. 6 is a cross-sectional side view of a fastener in a 25° open condition in accordance with the application.
Figure 7:
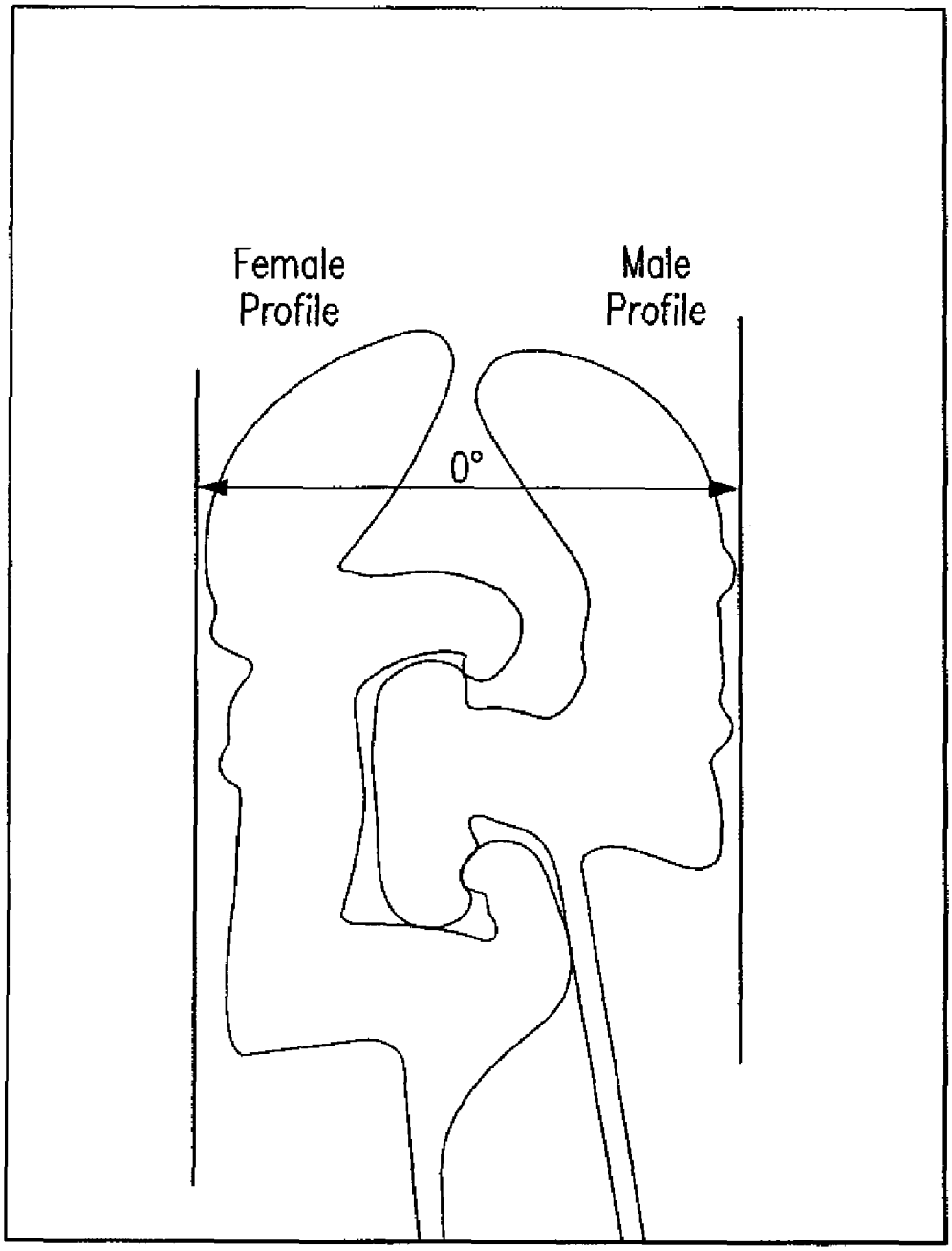
FIG. 7 is a cross-sectional side view of a fastener in a 0° open (i.e. a closed) condition in accordance with the application.

As shown in FIG. 6, for the purpose of illustration and not limitation, one portion of the profile that can distort or deflect is the second flange of the female profile, when the slider is moved from an open condition toward a closed condition. Additional portions of the female profile can also deflect or bend to allow the male rib to engage the female track, if desired. For example, the base 112 can bend at or near its thinnest portion. After the male rib is engaged in the female track, the second flange of the female profile can maintain the male profile matingly engaged with the female profile when the slider is in the closed condition, for example by providing an interlock that keeps the fastener closed with a light pressure.

In accordance with one aspect of the disclosed subject matter, the fastener can not be opened or closed without twisting or rolling action. For example, it is not possible to force the male and female profiles in FIG. 1 together with parallel side forces. Instead, the male and female tracks will bend and compress but will not interlock. By contrast, previously known fasteners that can be opened and closed without twisting will interlock when the male and female profiles are pressed together. However, such previously known fasteners must be made with smaller features that will bend to keep slider easy to open and close but will result in decreased seal strength. Fasteners in accordance with the disclosed subject matter can be made with stiffer plastics with larger cross sections which results in increased seal strength, but are still easy to open and close, with a low sliding closed force.

Figure 10:
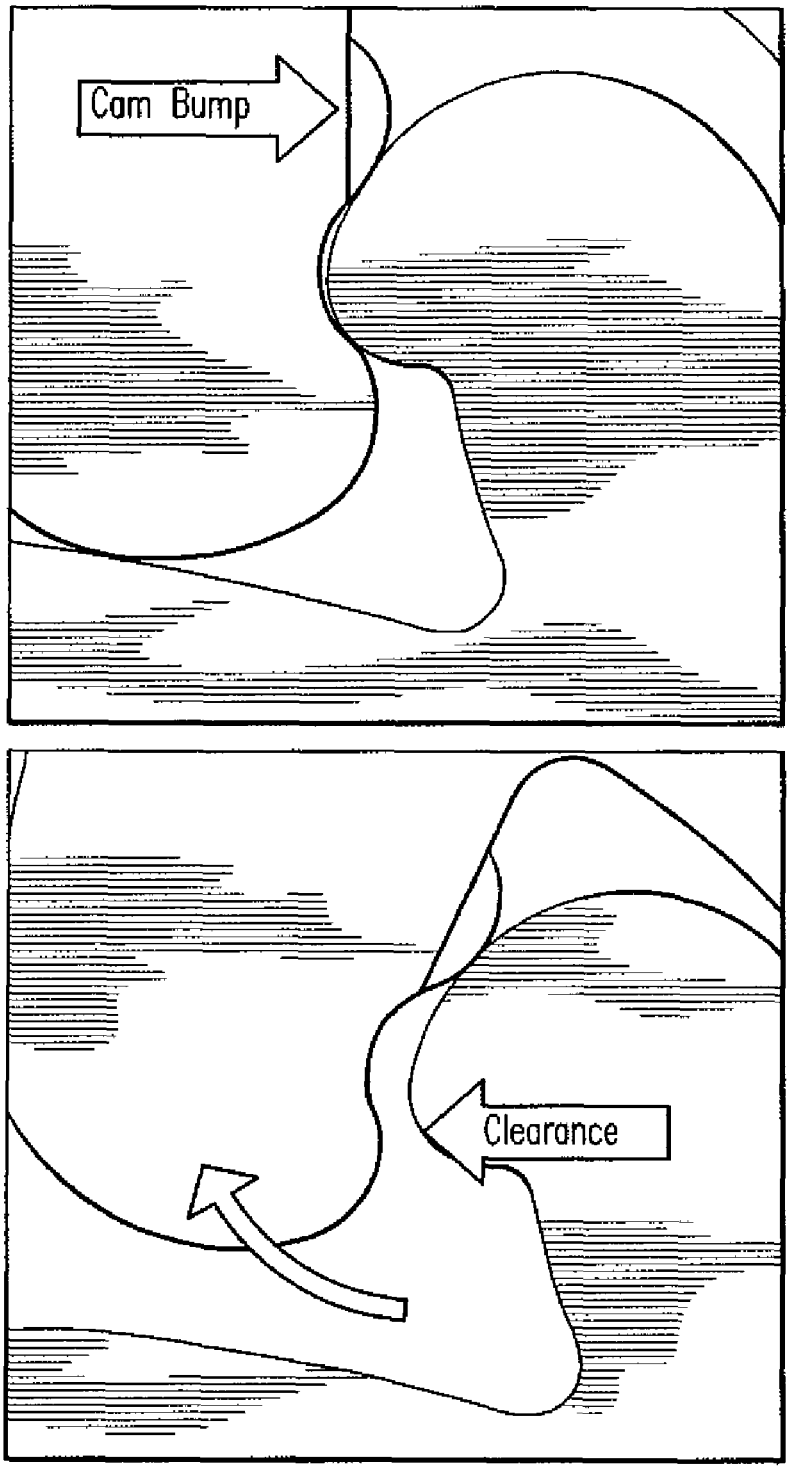
FIG. 10 is a schematic representation of the engaging and engagement surfaces of the fastener of FIG. 1 being moved out of engagement with each other.
Figure 11:
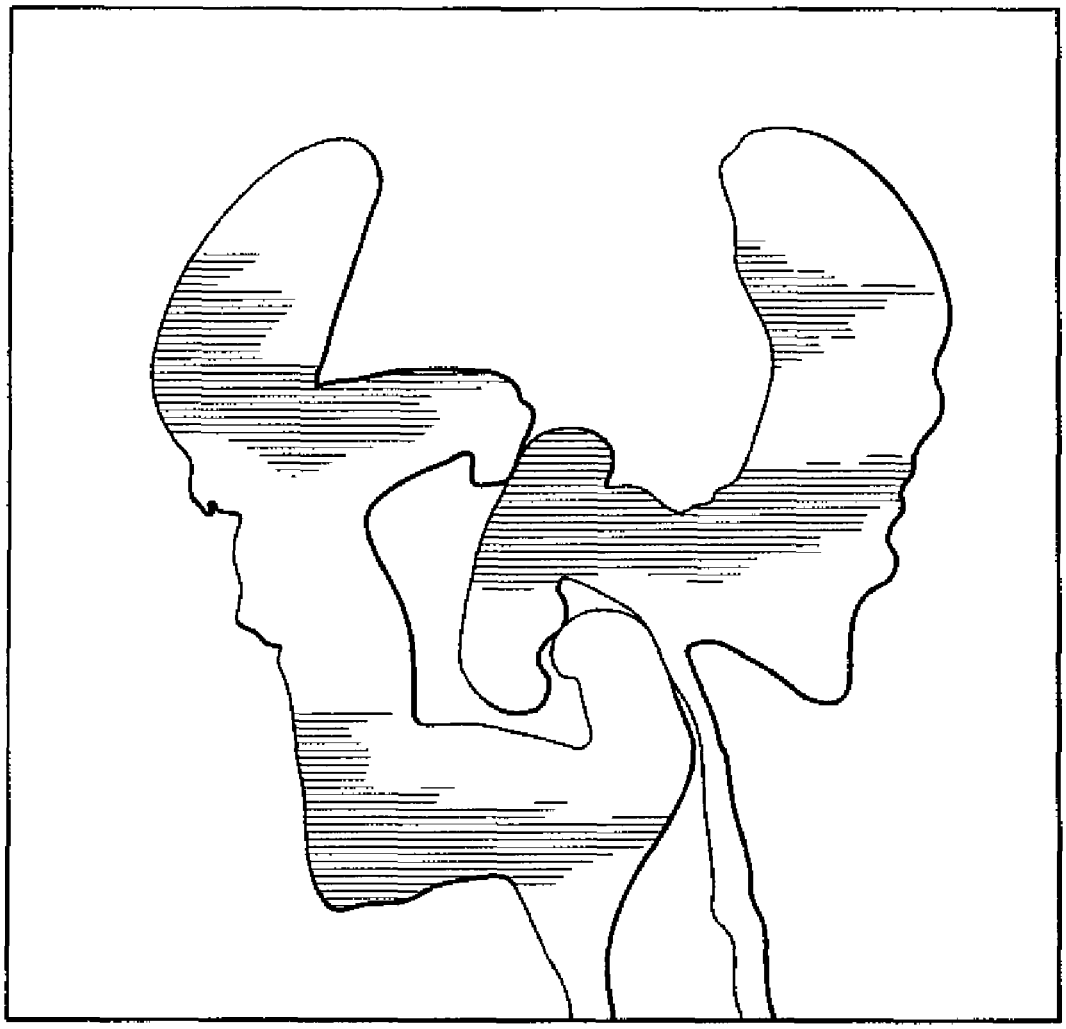
FIG. 11 is a sectional image of the fastener shown in FIG. 1 showing the fastener rotating toward the open position.

In accordance with another aspect of the disclosed subject matter, the inwardly-directed surface of the hook portion of the male track includes a cam surface 117, as shown in FIG. 1 and FIG. 10. The cam surface can be a projection, protrusion, bump or other suitable configuration to form a desired cam surface. For the purpose of illustration and not limitation, as shown in FIGS. 10 and 11, when rotating the fastener toward the open condition, the cam surface 117 urges the engaging surface out of engagement with the engagement surface, which helps the fastener to more easily fully open. The cam surface decreases the amount of rotation required to open the fastener, which in turn makes the fastener easier for the consumer to open using a slider. Therefore, fasteners including a cam surface in accordance with the application allow for more engagement and increased seal strength, without making the fastener harder to open. As demonstrated in the figure, it is understood that the combination of the cam surface with the projection on inwardly-directed surface of the rib of the male profile could be interpreted to define a recess.

Figure 12:
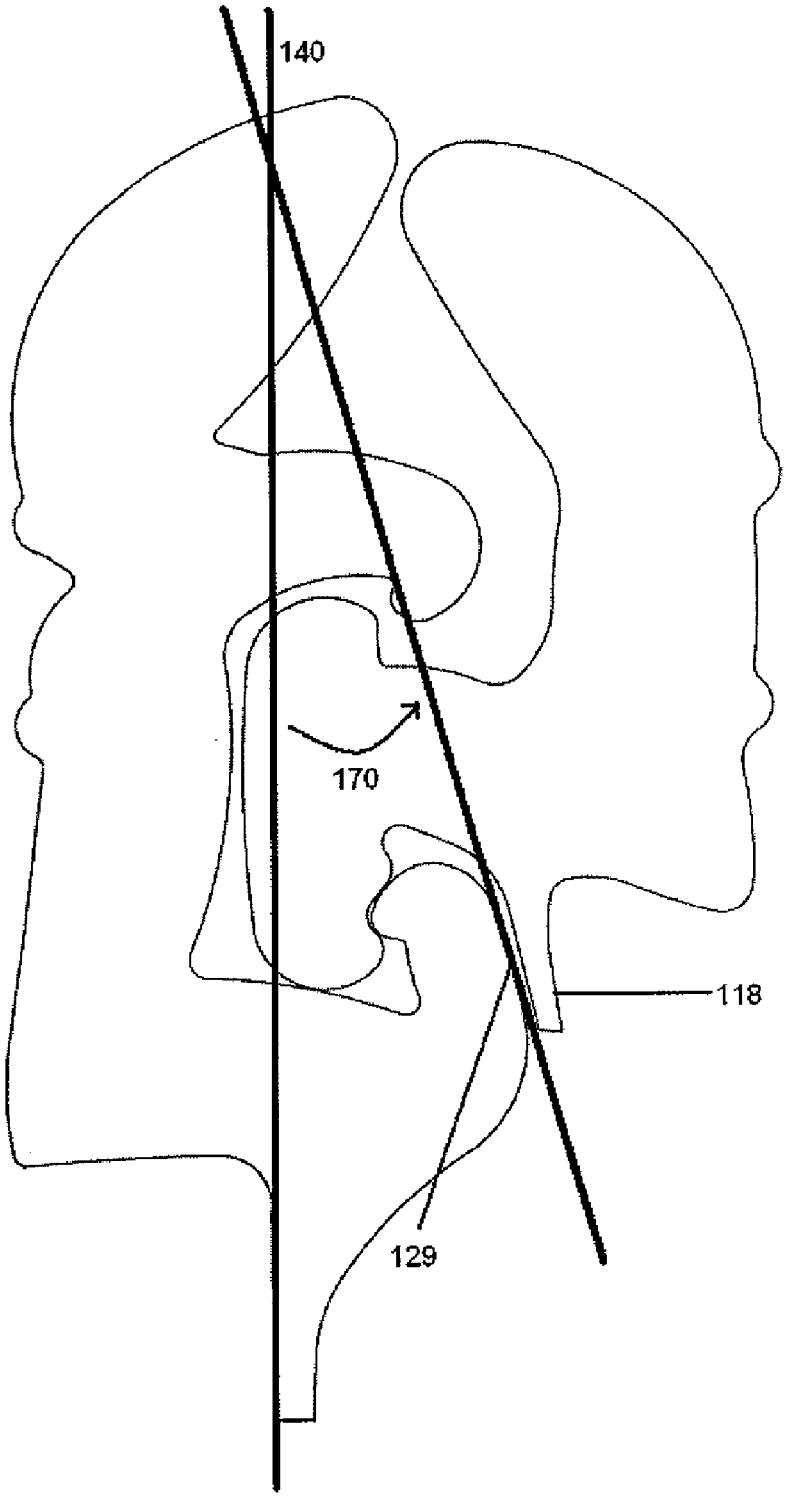
FIG. 12 is another cross-sectional side view of the fastener shown in FIG. 1 showing the angle of the outwardly-directed surface of the flange relative to a reference plane.

In accordance with another aspect of the disclosed subject matter, and as embodied herein, the first flange of the female profile has an outwardly-directed surface 129 having an angle 170 of between about 10 and about 30 degrees relative to the reference plane, as shown in FIG. 12 for the purpose of illustration and not limitation. Preferably the angle is about 20 degrees. It was originally believed that a straight outwardly-directed surface (having an angle of about 0 relative to the reference plane) was preferred. However, it was unexpectedly found that angling the outwardly direct surface between about 10 and about 30 degrees relative to the reference plane generally creates a spring force to assist in opening the fastener because the fin portion 118 (shown in FIG. 12) of the male portion pushes against the outwardly-directed surface 129 of the first flange of the female profile when the ear portions 190 and 191 are pulled apart (as shown in FIG. 11). Thus having an angled outwardly-directed surface in accordance with this application allows the consumer to more easily open the fastener using the slider.

In accordance with an aspect of the application, the male and female tracks can be made of any thermoplastics such as, for example, polyethylenes, including high density polyethylene (HDPE), medium density polyethylene (MDPE), low density polyethylene (LDPE), or mixtures thereof, polypropylene, polyethylene tetraphalate (PET), polyvinyl chloride (PVC), nylon or other suitable materials known in the art. Generally, using a stiffer grade material adds strength. However, because fasteners including engaging and engagement surfaces in accordance with the present application increase the seal strength, a wider range of stiffness of materials are available for use. Thus fasteners in accordance with the present application are less dependent on material properties than for fasteners without the engaging and engagement surfaces of this application.

In one embodiment, the inwardly-directed surface 114 of the rib of the male profile and the inwardly-directed surface 124 of the first flange of the female profile could have at lest one additional projection defining at least second engagement and engaging surfaces, respectively. A fastener including two or more engagement and engaging surfaces could include any of the additional features described above.

In accordance with one aspect of the application, another reclosable fastener is provided. The reclosable fastener comprises a male track including a male profile, a female track including a female profile, and a slider disposed on the male and female tracks to matingly engage the male profile and the female profile when moved from an open condition toward a closed condition. The slider is configured to first press together a bottom of the male and female profiles and then roll the profiles closed toward a top thereof as the slider moves toward the closed condition. The male profile comprises a base and a rib with a first hook portion and a second hook portion extending in opposite direction from the rib. The first hook portion has an inwardly-directed surface including a projection defining an engagement surface. The female profile comprises a base with a first flange and a second flange, the first flange having an inwardly-directed surface including a projection defining an engaging surface. The engaging surface of the female track engages the engagement surface of the male track when in the closed condition with at least a portion of the male profile received by at least a portion of the female profile. The fastener can have any of the additional features described above.

In accordance another aspect of the application, a reclosable bag is provided. The plastic bag includes first and second panels each having a top, a bottom, and first and second opposing sides and a reclosable fastener. The first and second panels are joined to each other along respective bottoms and first and second opposing sides. The reclosable fastener can be any of the fasteners described herein above and can have any of the additional features described above. For example, the fastener comprises a male track including a male profile, a female track including a female profile, and a slider disposed on the male and female tracks to matingly engage the male profile and the female profile when moved from an open condition toward a closed condition. The slider includes a back and a pair of sidewall depending therefrom. The slider also has a separator finger depending from the back between the pair of sidewalls and shaped along its length to first press together a bottom of the male and female profiles and then roll the profiles closed toward a top thereof as the slider moves toward the closed condition. The male profile comprises a base and a rib with a hook portion having an inwardly-directed surface including a projection defining an engagement surface. The female profile comprises a base and a first flange having an inwardly-directed surface including a projection defining an engaging surface. The engaging surface of the female track engages the engagement surface of the male track when in the closed condition with at least a portion of the male profile received by at least a portion of the female profile.

Figure 13:
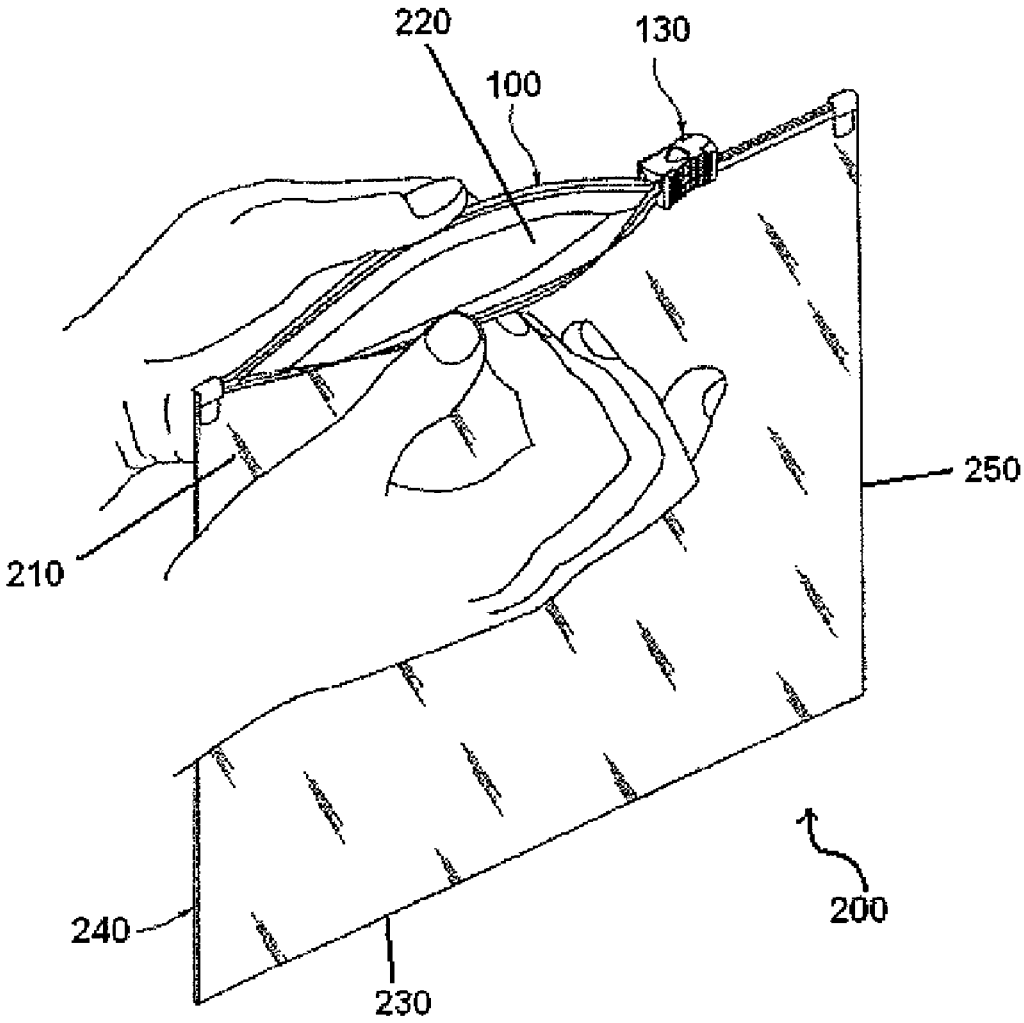
FIG. 13 is a bag including a fastener in accordance with the application.

For purpose of explanation and illustration, and not limitation, an exemplary embodiment of the reclosable bag in accordance with the application is shown in FIG. 13. The plastic bag 200 comprises first and second panels 210 and 220 each having a top, a bottom, and first and second opposing sides and a reclosable fastener 100. The first and second panels are joined to each other along respective bottoms 230 and first and second opposing sides 240 and 250. The bag 200 may be made from any suitable thermoplastic film such for example as polyethylene or polypropylene or other suitable materials known in the art. The slider 130 has been illustrated in FIG. 13 assembled on the fastener 100 at the top edge or mouth of a thermoplastic bag 200. The reclosable fastener 100 can have any combination of the features described above. For example, the fastener can include male and female tracks extending along the length of the top of the first and second opposing sides 210 and 220 and may be extruded separately and attached to the respective sides of the bag mouth or the male and female tracks may be extruded integral with the sides of the bag mouth.

Example

Figure 14:
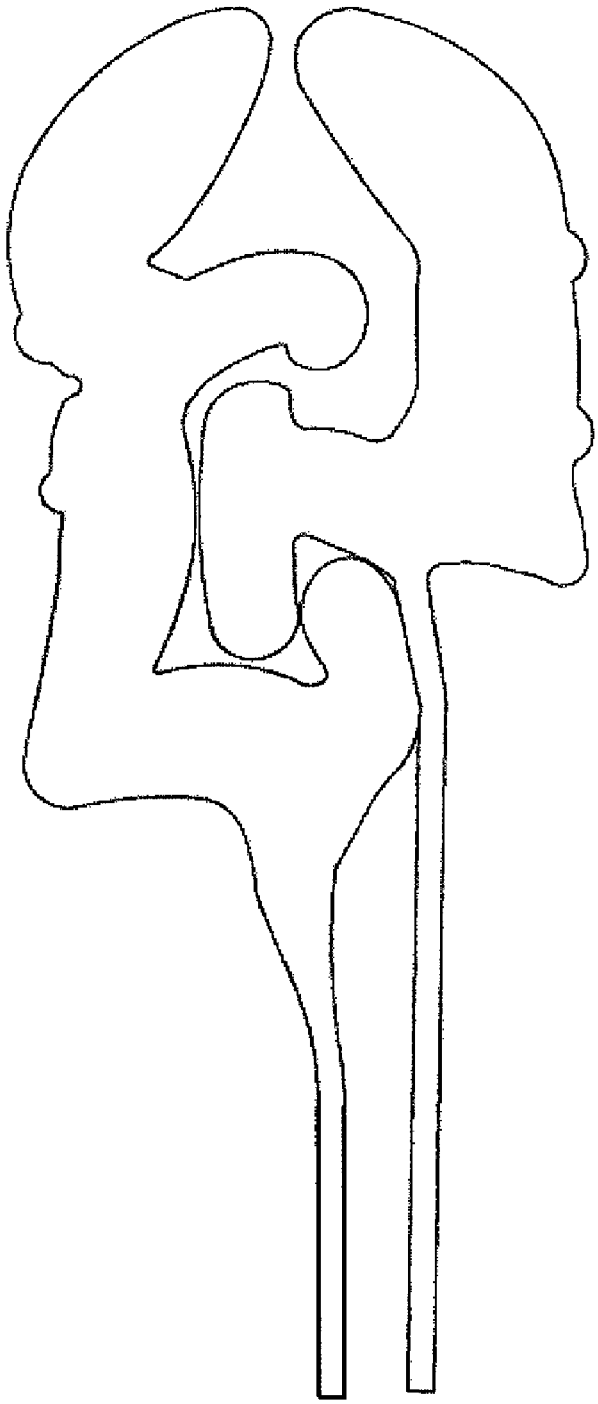
FIG. 14 is a cross-sectional side view of a Hefty® One Zip® fastener used as a control in the Example described in the application.

Reclosable plastic fasteners having engaging and engagement surfaces in accordance with the application were formed and the seal strength was tested and compared to control fasteners that did not include the engaging and engagement surfaces. The control fasteners tested were Hefty® One Zip® slider bags commonly available as of the filing date of the application and as depicted in FIG. 14. ASTM test method F 88/F 88M-09 was used to test the seal strength of the bags.

Figure 15:
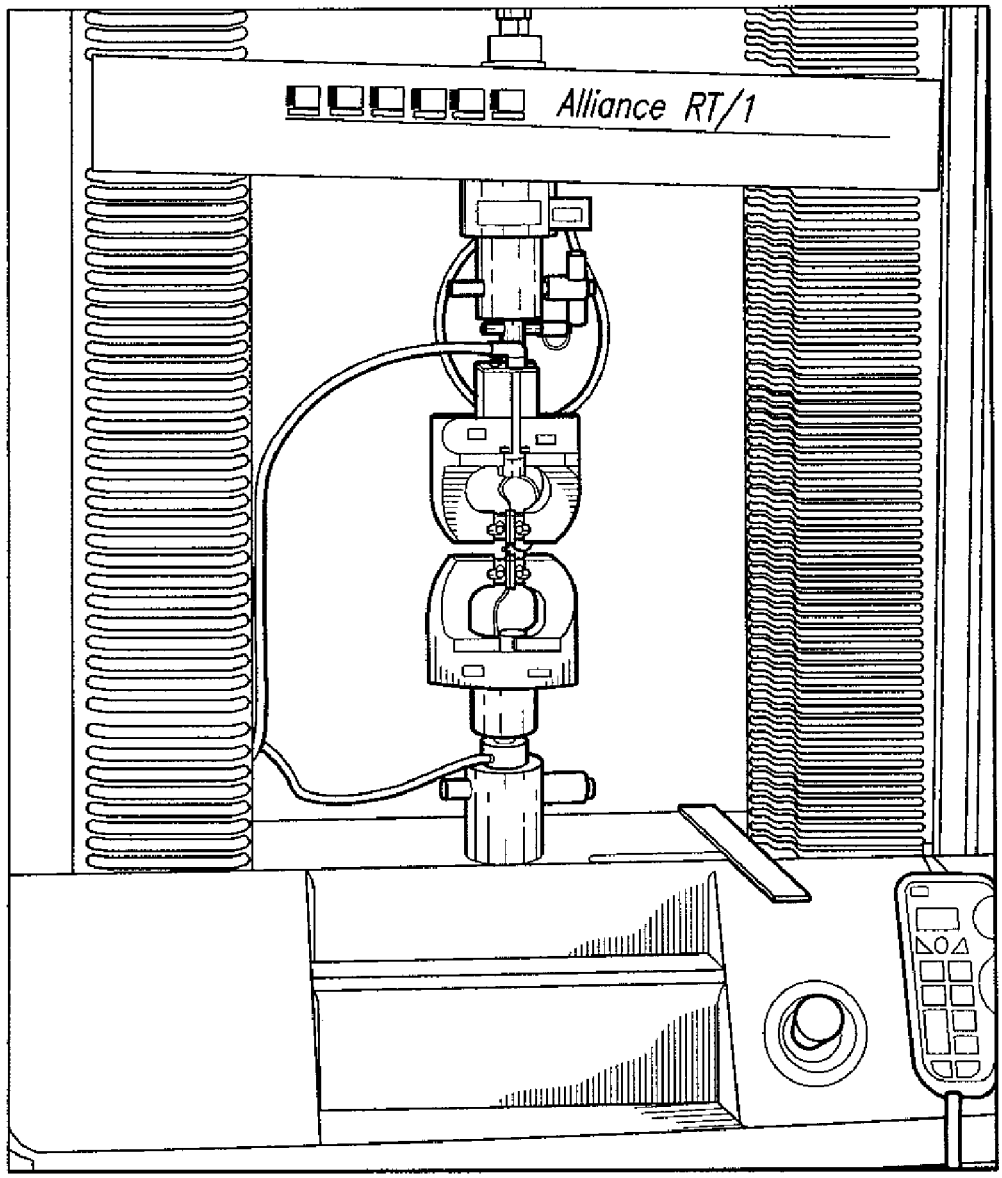
FIG. 15 is an image of a constant rate-of-jaw-separation machine for testing fasteners in accordance with the application.

Specimens were cut to a width of 1.00 inch (with a tolerance of + or −0.5%) using a cutter conforming to the requirements of 5.4 of Test Methods D 882. The edges were clean-cut and perpendicular to the direction of seal. The length of the specimen fins could be of a different length depending on the grip dimensions of the testing machines. To perform the test, a constant rate-of-jaw-separation machine was used, as shown in FIG. 15. The machine was equipped with a weighing system that moves a maximum distance of 2% of the specimen extension within the range being measured. The machine was equipped with a device for recording the tensile load and the amount of separation of the grips (both being accurate to + or −2%). The rate of separation of the jaws was uniform and capable of adjustment from approximately 8 to 12 inches per minute. The gripping system was capable of minimizing specimen slippage and applying an even stress distribution on the specimen. The machine was calibrated.

Figure 16A:
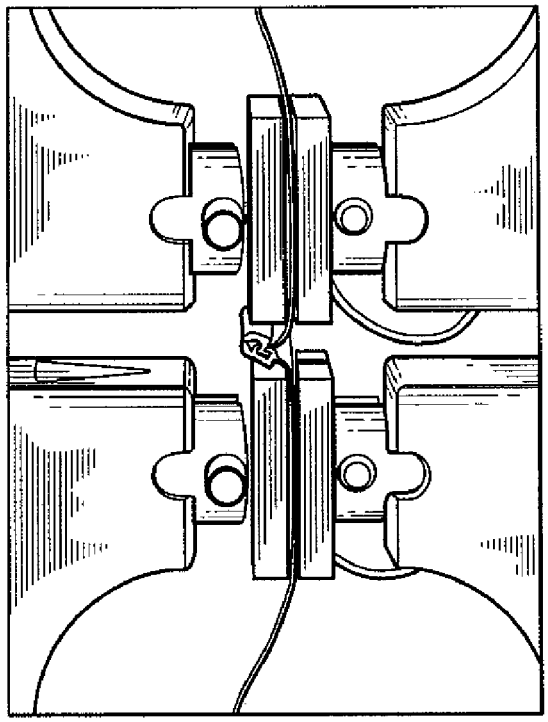
FIGS. 16A and 16B are close up images of the constant rate-of-jaw-separation machine of FIG. 15.
Figure 16B:
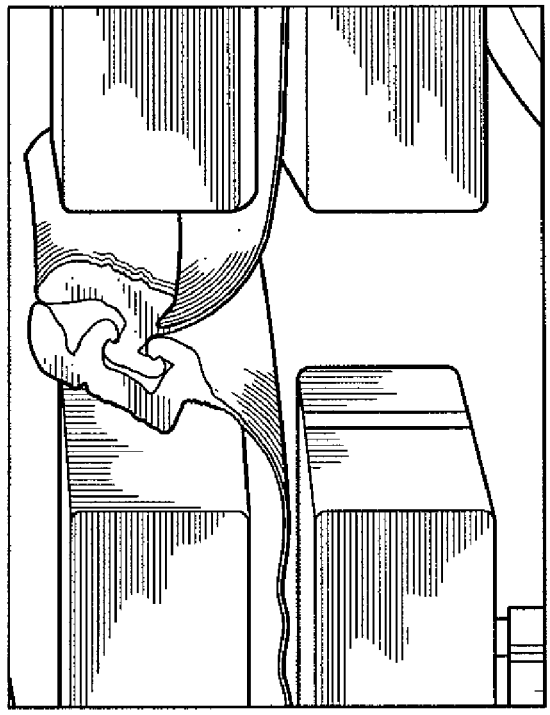

As shown in FIGS. 16A and 16B, each fin of the fastener was secured in opposing grips of the testing machine and the fastener profiles remaining unsupported while the test was conducted. The fastener profiles were located approximately equidistant between the grips and about 0.25 inches from each of the grips. The specimen was aligned in the grips so that the fastener was perpendicular to the direction of pull while allowing sufficient slack so the fastener is not stressed prior to initiation of the test. The fastener specimen is then tested at a rate of grip separation of 10 inches per minute. For each cycle, the maximum force encountered as the specimen is stressed to a preset travel distance of 0.5 inches (+ or −0.5%) was reported. Some specimens failed before the full distance of travel and the mode of specimen failure was identified.

Figure 17:
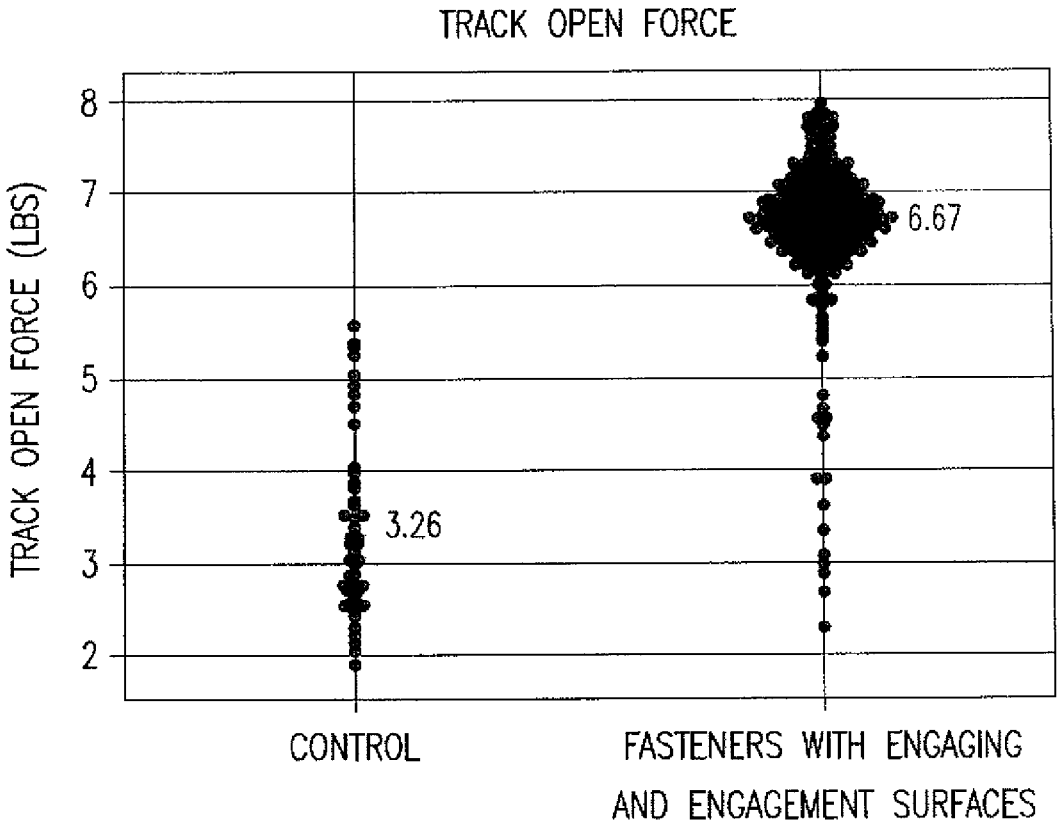
FIG. 17 is a graph of test data showing the increased seal strength of fasteners in accordance with the application.

FIG. 17 shows the increase in seal strength of the fasteners in accordance with the present application. The data for control fasteners, Hefty® One Zip® slider bags as depicted in FIG. 14, not including the engaging and engagement surface is shown at the left of FIG. 17 and the data includes 75 data points where each data point is an average of 5 samples. The data for fasteners in accordance with the application are shown on the right of FIG. 17 and includes 610 data points where each data point is also an average of 5 samples.

For the control, the mean value of the force to open the track was 3.26 lbs. with a standard deviation of 0.88 lbs and a standard Error Mean of 0.1 lbs. For fasteners in accordance with the application, the mean value of the force to open the track was 6.67 lbs. with a standard deviation of 0.65 lbs and a standard Error Mean of 0.03 lbs. Thus, the mean values of fasteners in accordance with the application are about 100% stronger than control fasteners without engaging and engagement surfaces. Furthermore, the "track open force" data collected for fasteners having engaging and engagement surfaces in accordance with the application actually reflects the force required for the failure of the material of the fin rather than a bursting open of the fastener because the engaging and engagement surfaces in accordance with the application are effective at holding the fastener closed even at forces sufficient to deform the material of the fin. As demonstrated by the data, fasteners having engaging and engagement surfaces in accordance with the application can withstand track open forces over about 6 lbs/inch of fastener without bursting open.

While the present application is described herein in terms of certain preferred embodiments, those skilled in the art will recognize that various modifications and improvements may be made to the application without departing from the scope thereof. Thus, it is intended that the present application include modifications and variations that are within the scope of the appended claims and their equivalents. Moreover, although individual features of one embodiment of the application may be discussed herein or shown in the drawings of one embodiment and not in other embodiments, it should be apparent that individual features of one embodiment may be combined with one or more features of another embodiment or features from a plurality of embodiments.

In addition to the specific embodiments claimed below, the application is also directed to other embodiments having any other possible combination of the dependent features claimed below and those disclosed above. As such, the particular features presented in the dependent claims and disclosed above can be combined with each other in other manners within the scope of the application such that the application should be recognized as also specifically directed to other embodiments having any other possible combinations. Thus, the foregoing description of specific embodiments of the application has been presented for purposes of illustration and description. It is not intended to be exhaustive or to limit the application to those embodiments disclosed.

The invention claimed is:

1. A reclosable fastener comprising:

a male track including a male profile comprising a base and a rib with a hook portion having an inwardly-directed surface including a projection defining an engagement surface;

a female track including a female profile comprising a base and a first flange having an inwardly-directed surface including a projection defining an engaging surface; and a slider disposed on the male and female tracks to matingly engage the male profile and the female profile when moved from an open condition toward a closed condition, the slider including a back and a pair of sidewall depending therefrom, the slider further having a separator finger depending from the back between the pair of sidewalls and shaped along its length to first press together a bottom of the male and female profiles and then roll the profiles closed toward a top thereof as the slider moves toward the closed condition;

wherein the engaging surface of the female track engages the engagement surface of the male track when in the closed condition with at least a portion of the male profile received by at least a portion of the female profile.

2. The reclosable fastener of claim 1, wherein the female track includes a downwardly-depending fin portion defining a reference plane.

3. The reclosable fastener of claim 2, wherein the engaging surface and the engagement surface engage each other at a location of contact when in the closed condition, the engaging surface having an angle of between about 30 degrees to about 80 degrees relative to the reference plane at the location of contact.

4. The reclosable fastener of claim 2, wherein the engaging surface and the engagement surface engage each other at a location of contact when in the closed condition, the engagement surface having an angle of between about 30 degrees to about 80 degrees relative to the reference plane at the location of contact.

5. The reclosable fastener of claim 3, wherein the engaging surface and the engagement surface each have an angle of about 45 degrees relative to the reference plane at the location of contact.

6. The reclosable fastener of claim 2, wherein the engaging surface and the engagement surface are each angled at a location of contact generally perpendicular to a predetermined direction of pull.

7. The reclosable fastener of claim 2, wherein the first flange has an outwardly-directed surface at an angle of between about 10 and about 30 degrees relative to the reference plane.

8. The reclosable fastener of claim 1, wherein the inwardly-directed surface of the hook portion of the rib further comprises a cam surface proximate the projection.

9. The reclosable fastener of claim 8, wherein the cam surface is configured to urge the engaging surface out of engagement with the engagement surface when the slider is moved toward the open condition.

10. The reclosable fastener of claim 1, wherein the engaging surface and the engagement surface form a mechanical interference when in the closed position.

11. The reclosable fastener of claim 1, wherein the rib further includes a second hook portion and wherein the female profile further comprises a second flange.

12. The reclosable fastener of claim 1, wherein the male and female profiles have complementary cross-sections.

13. The reclosable fastener of claim 1, wherein at least one of the male track and the female track includes a fin portion.

14. The reclosable fastener of claim 1, wherein the male profile further comprises an ear portion and the female profile further comprises an ear portion.

15. The reclosable fastener of claim 14, wherein the ear portion of the male profile is in contact with the ear portion of the female profile when in the closed condition.

16. The reclosable fastener of claim 1, wherein the female track further comprises a second flange arranged to deflect when the slider is moved from an open condition toward a closed condition.

17. The reclosable fastener of claim 16, wherein the second flange maintains the male profile matingly engaged with the female profile when the slider is in the closed condition.

18. The reclosable fastener of claim 1, wherein the slider disengages the male profile from the female profile when moved from the closed condition toward the open condition such that the slider first separates the top of the male and female profiles and then rolls the profiles open toward the bottom thereof as the slider moves toward the open condition.

19. A reclosable fastener comprising:

a male track including a male profile comprising a base and a rib with a first hook portion and a second hook portion extending in opposite direction from the rib, the first hook portion having an inwardly-directed surface including a projection defining an engagement surface;

a female track including a female profile comprising a base with a first flange and a second flange, the first flange having an inwardly-directed surface including a projection defining an engaging surface; and a slider disposed on the male and female tracks to matingly engage the male profile and the female profile when moved from an open condition toward a closed condition, the slider being configured to first press together a bottom of the male and female profiles and then roll the profiles closed toward a top thereof as the slider moves toward the closed condition;

wherein the engaging surface of the female track engages the engagement surface of the male track when in the closed condition with at least a portion of the male profile received by at least a portion of the female profile.

20. A reclosable plastic bag, comprising:

first and second panels each having a top, a bottom, and first and second opposing sides, the first and second panels being joined to each other along respective bottoms and first and second opposing sides; and reclosable fastener comprising a male track including a male profile comprising a base and a rib with a hook portion having an inwardly-directed surface including a projection defining an engagement surface;

a female track including a female profile comprising a base and a first flange having an inwardly-directed surface including a projection defining an engaging surface; and a slider disposed on the male and female tracks to matingly engage the male profile and the female profile when moved from an open condition toward a closed condition, the slider including a back and a pair of sidewall depending therefrom, the slider further having a separator finger depending from the back between the pair of sidewalls and shaped along its length to first press together a bottom of the male and female profiles and then roll the profiles closed toward a top thereof as the slider moves toward the closed condition;

wherein the engaging surface of the female track engages the engagement surface of the male track when in the closed condition with at least a portion of the male profile received by at least a portion of the female profile.

* * * * *